US011697120B2

(12) United States Patent
Riggenmann

(10) Patent No.: US 11,697,120 B2
(45) Date of Patent: Jul. 11, 2023

(54) IMPACT CRUSHER

(71) Applicant: Michael Riggenmann, Weissenhorn (DE)

(72) Inventor: Michael Riggenmann, Weissenhorn (DE)

(73) Assignee: TRENN- UND SORTIERTECHNIK GMBH, Weissenhorn (DE)

( * ) Notice: Subject to any disclaimer, the term of this patent is extended or adjusted under 35 U.S.C. 154(b) by 205 days.

(21) Appl. No.: 16/999,103

(22) Filed: Aug. 21, 2020

(65) Prior Publication Data

US 2021/0053068 A1 Feb. 25, 2021

(30) Foreign Application Priority Data

Aug. 21, 2019 (DE) ..... 102019005890.9

(51) Int. Cl.

| | |
|---|---|
| ***B02C 13/16*** | (2006.01) |
| ***B02C 13/28*** | (2006.01) |
| ***B02C 13/282*** | (2006.01) |
| ***B02C 13/14*** | (2006.01) |

(52) U.S. Cl.

CPC ..... *B02C 13/16* (2013.01); *B02C 13/14* (2013.01); *B02C 13/28* (2013.01); *B02C 13/282* (2013.01); *B02C 2013/2808* (2013.01)

(58) Field of Classification Search

CPC . B02C 13/284; B02C 13/2808; B02C 13/282; B02C 13/28; B02C 13/14; B02C 13/16

See application file for complete search history.

(56) References Cited

U.S. PATENT DOCUMENTS 1,586,282 A * 5/1926 Bryant ..... B02C 13/14 241/154
1,636,033 A * 7/1927 Agnew ..... B02C 13/14 241/154
1,669,239 A * 5/1928 Grindle ..... B02C 13/14 241/43
1,798,465 A * 3/1931 Grindle ..... B02C 13/28 241/82

(Continued)

FOREIGN PATENT DOCUMENTS

GB 2131722 A * 6/1984 ..... B02C 13/16

*Primary Examiner* — Faye Francis
(74) *Attorney, Agent, or Firm* — Andrew Wilford

(57) ABSTRACT

An impact crusher for grinding and separating solid material has a base and a rotor on the base having an upright shaft defining an upright rotor axis about which the rotor is rotatable and a plurality of vertically spaced and radially horizontally outwardly extending plates each having an outer periphery. A drum fixed on the base spacedly surrounds the rotor. An array of axially extending and angularly substantially equispaced replaceable ribs is provided on an inner surface of the drum. A respective plurality of impact hammers are angularly substantially equispaced around the outer periphery of each of the disks. Respective mounting pivots support the hammers on the outer peripheries of the plates for pivoting about respective hammer axes parallel to the rotor axis so that rotation of the rotor grinds material between the hammers and the ribs. Formations between the mounting pivots and the respective disks enable radial adjustment and fixing of the hammer axes relative to the rotor axis.

16 Claims, 5 Drawing Sheets

(56) References Cited

U.S. PATENT DOCUMENTS 1,955,960 A * 4/1934 Hirsch ..... B02C 13/14 241/194
2,329,208 A * 9/1943 Lykken ..... B02C 13/14 241/59
2,355,784 A * 8/1944 Dondlinger ..... F23K 1/00 241/188.1
2,440,285 A * 4/1948 Lykken ..... B02C 13/14 241/43
2,695,755 A * 11/1954 Denovan ..... B02C 13/28 241/4
2,700,511 A * 1/1955 Denovan ..... B02C 13/14 241/154
3,329,350 A * 7/1967 Wisgerhof ..... B02C 13/18 241/38
4,087,052 A * 5/1978 Rohrbach ..... B02C 13/14 241/162
4,373,679 A * 2/1983 Kawano ..... B02C 13/1814 241/275
5,046,670 A * 9/1991 Leikin ..... B02C 13/28 241/275
5,067,661 A * 11/1991 Eide ..... B02C 18/16 241/DIG. 38
9,403,167 B2 * 8/2016 Watts ..... B02C 13/09
9,498,780 B2 * 11/2016 Watts ..... B02C 13/14
9,707,564 B2 * 7/2017 Mogan ..... B02C 13/18
10,376,894 B2 * 8/2019 Sontag ..... B02C 13/288
10,493,461 B2 * 12/2019 Shirai ..... B02C 13/14
11,298,703 B2 * 4/2022 Lutoslawski ..... B02C 13/14
2008/0185466 A1 * 8/2008 Howard ..... B02C 13/282 241/188.1
2012/0119003 A1 * 5/2012 Watts ..... B02C 7/02 241/101.2
2016/0144371 A1 * 5/2016 Sontag ..... B02C 13/16 241/47
2017/0065982 A1 * 3/2017 Koslow ..... B02C 13/16
2020/0269252 A1 * 8/2020 Bano ..... B02C 13/16

* cited by examiner

IMPACT CRUSHER

FIELD OF THE INVENTION

The present invention relates to an impact crusher. More particularly this invention concerns an impact crusher for comminuting hard material into particles.

BACKGROUND OF THE INVENTION

An impact crusher for grinding solid material, particularly waste material, as well as for separating composite material made of metals, plastics, mineral substances and the like, comprises a rotor on a machine base and having a upright rotor shaft as well as a drum surrounding the rotor shaft with clearance and is provided on its inner surface with replaceable ribs running axially of the rotor shaft. The rotor is provided with also replaceable impact hammers adjacent the ribs, the ribs and the impact hammers being essentially evenly distributed angularly around the axis of the rotor.

Such devices are known from the prior art and are used to separate composite material, particularly by crushing. Of particular significance are metal and plastic composites, but composite material that consist of various metals or also various plastics can also be crushed. Separation is achieved by the fact that the physical properties of the individual components of the composite material differ so that when the material strike the ribs or the impact hammers, a different elastic or plastic deformation is achieved as a result of which separation occurs.

The size of the formed "granulate," which depends on the spatial dimensions of the impact crushers, hereby also has a large influence on the result of the later separation quality. Therefore, it is desirable that a mutual physical adjustment of the ribs and impact hammers can be undertaken, particularly since the clearance when used as intended also has an influence on the wear of the impact tools, with maintenance becoming less necessary on a regular basis or replacement of the impact tools can be decreased.

OBJECTS OF THE INVENTION

It is therefore an object of the present invention to provide an improved impact crusher.

Another object is the provision of such an improved impact crusher that overcomes the above-given disadvantages, in particular in which the impact hammers are adjustable radially of the rotor axis with respect to the ribs and are accessible for this purpose with little effort so that inspections, cleaning as well as replacements that may have become necessary if applicable can also be performed in a simple manner with little time involved.

SUMMARY OF THE INVENTION

An impact crusher for grinding and separating solid material according to the invention has a base and a rotor on the base having an upright shaft defining an upright rotor axis about which the rotor is rotatable and a plurality of vertically spaced and radially horizontally outwardly extending plates each having an outer periphery. A drum fixed on the base spacedly surrounds the rotor. An array of axially extending and angularly substantially equispaced replaceable ribs is provided on an inner surface of the drum. A respective plurality of impact hammers are angularly substantially equispaced around the outer periphery of each of the disks. Respective mounting pivots support the hammers on the outer peripheries of the plates for pivoting about respective hammer axes parallel to the rotor axis so that rotation of the rotor grinds material between the hammers and the ribs. Formations between the mounting pivots and the respective disks enable radial adjustment and fixing of the hammer axes relative to the rotor axis.

The advantage achieved by the invention consists essentially in that by radial adjustment of the impact hammers, the distance between their pivot axes and inner surfaces of the ribs can be easily adjusted to the items to be milled.

In a particularly advantageous manner, for this purpose there can be a respective plurality of detachable adjusting disks on each of the rotor plates for each impact hammer. Each hammer is eccentrically pivoted on a pin on the respective adjusting disk. Rotating the adjusting disk changes the radial spacing between the respective hammer axis and the rotor axis and the fore also the radial spacing between an outer end of the respective hammer and the inner surfaces of the ribs.

To adjust defined clearances without much effort, the shape of the outer edge of adjusting disk is advantageously formed by a regular polygon so the adjusting disk can be connected to the rotor plate in a manner where position of the respective hammer axis is radially variable relative to the rotor axis.

A suitable and therefore preferred design with the scope of the invention is selected in such a manner that the adjusting disk is formed by a 12-sided polygon.

To optimally absorb the occurring forces, the rotor plates are provided with mounting holes forming complementary polygonal seats for the respective adjusting disks.

Furthermore, it has proven to be advantageous, especially for replacement, when the impact hammers are provided with U-shaped inner ends forming a pincer-shaped connection so as to grasp around the rotor plate and are connected to the adjusting disk by the pivot pin projecting above the upper face and below the lower face of the respective adjusting disk and plate.

To achieve simple access to the drum interior, that the drum is formed of two drum half-shells that are separable from each other at a plane including the rotor axis. By the bisection of the drum, a simple separation of the two drum half-shells can be undertaken so that the drum inner surface fitted with the ribs become not only readily accessible, but similarly so does the rotor with the impact hammers.

In a preferred embodiment of the invention, both drum half-shells are connected at axially extending edge to a respective pivot shaft parallel to the rotor shaft. The two pivot shafts diametrally oppose each other relative to the rotation axis and lie on the plane where the rotors meet in the closed position. In this way, the two drum half-shells in the open position of the drum remain connected for further work on the impact crusher, which simplifies inspection as well as mechanical tasks for replacing the ribs.

In an advantageous design of the invention, the pivot shafts are thereby mounted at their lower end on the machine base and with their upper end in a horizontally extending arm of a U-shaped machine frame crossing over and connected to the machine base.

It is hereby also advantageous if the drum half-shells are at least limitedly axially displaceable on the respective pivot shafts relative to the stationary base and frame. One can hereby slightly lift the drum half-shells from the machine base for when pivoting open the half-shells.

To absorb the high forces acting on the drum when in operation, the drum half-shells are bolted together at their axially extending edges and/or have their upper and/or lower edges abutting the machine base bolted to the machine base.

Furthermore, the drum half-shells have their upper ends facing away from the machine base closed by a respective semicircular upper wall or lid that itself is formed with a fill/inlet air opening. In this way, the impact crusher can be continuously fed the composite material to be separated.

In a corresponding manner, it is provided that a material discharge/outlet air port is provided inside the drum in the bottom of the machine base.

In addition, it has proven to be advantageous if the rotor shaft is mounted in a bearing on the machine base as well as on the machine frame between the pivot shafts.

The ribs advantageously rest in respective radially inwardly open and axially extending grooves of the drum halves and alternatingly have a variable radial dimension. In this way, the ribs each protruding radially further inward from the actual drum form suitable edges where the composite material can be crushed.

Last, it is advantageous if the distance between the impact hammers and the ribs decreases vertically downward. In this way, coarse grinding occurs in the upper region initially and the degree of grinding increases in a downward direction due to the decreasing distance. The throughput in material can be increased by an air current being generated via the inlet air or outlet air port.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
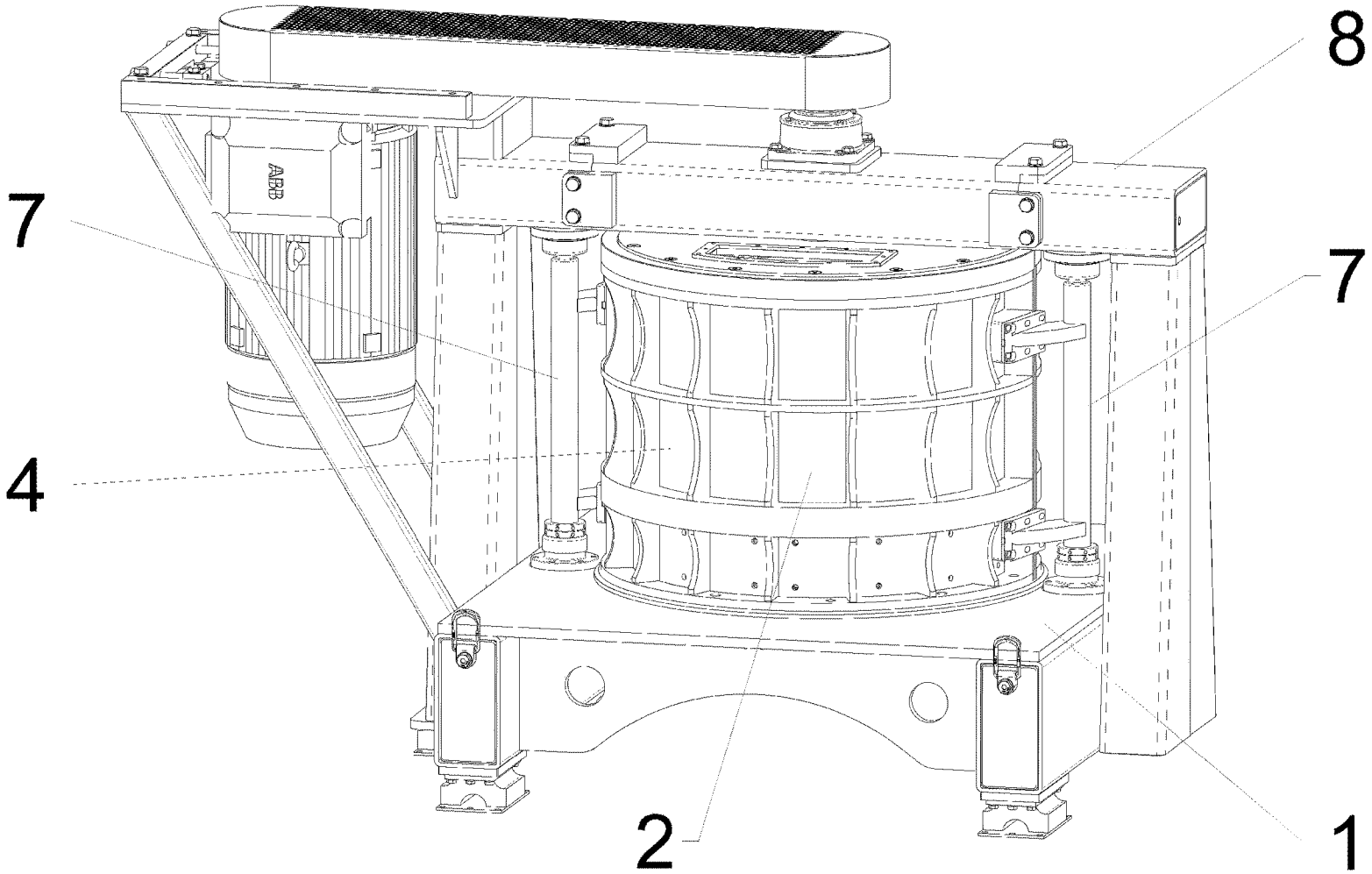
FIG. 1 is a perspective view from above of an impact crusher when closed.

The impact crusher depicted in the drawing is used for grinding solid material, particularly waste material, as well as for separating composite material made of metals, plastics, mineral substances and similar. It comprises a rotor 2 mounted on a machine base 1 and having an upright or vertical rotor shaft 3 defining an axis A, as well as a drum 4 spacedly surrounding the rotor 2. To grind solid material, the drum 4 is provided on its inner surface with replaceable ribs 5 extending axially of the rotor shaft 3. The rotor 2 is also provided with arrays of replaceable and pivotal impact hammers 6 working together with but spaced from the ribs 5. The ribs 5 and the impact hammers 6 are angularly evenly distributed about the upright rotor axis A.

Figure 3:
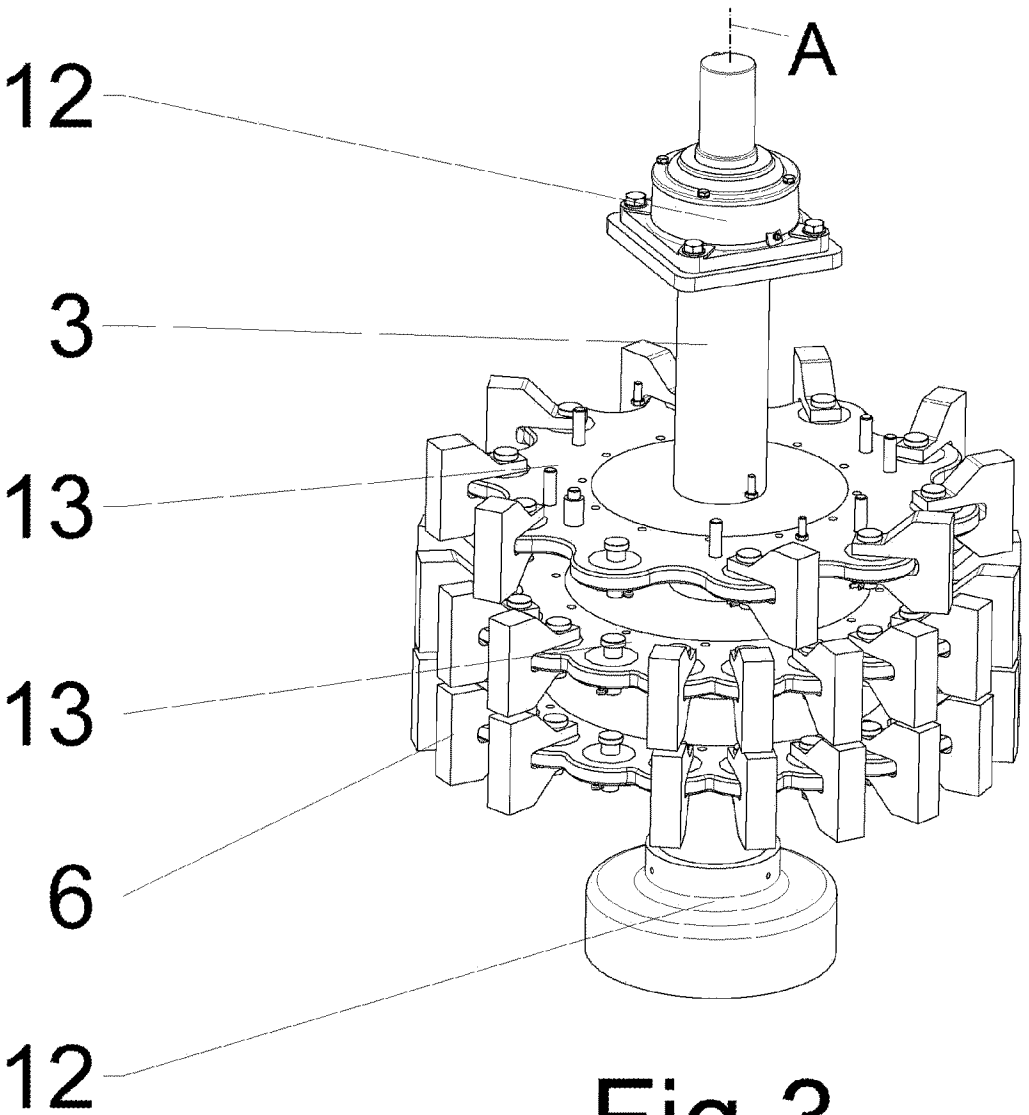
FIG. 3 is a view of the rotor and its impact hammers.
Figure 4:
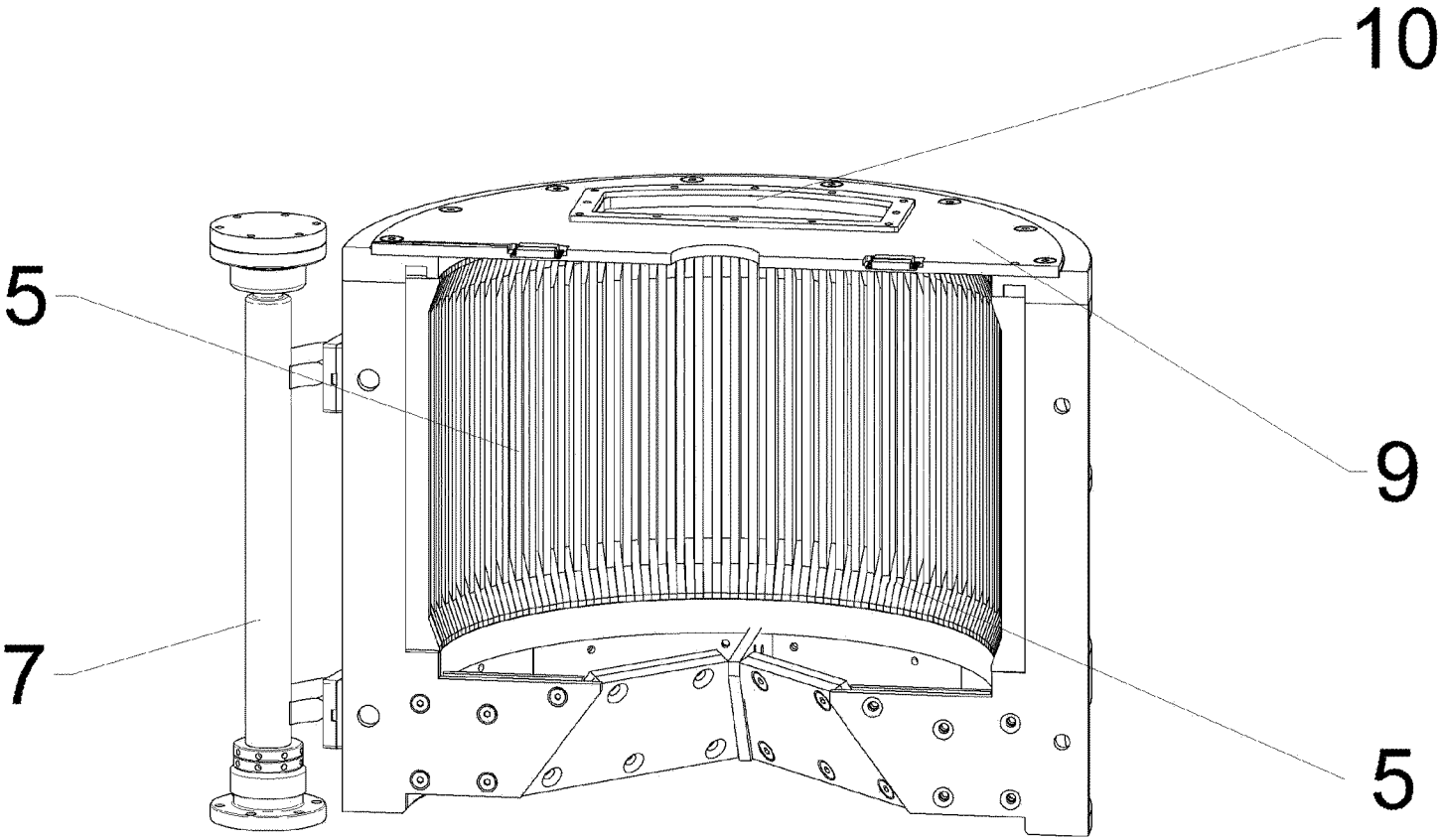
FIG. 4 is a view of the inner surface of one of the drum shells.

According to FIG. 3, the rotor 2 also has a plurality of rotor plates 13 extending radially from and spaced axially along the shaft 3, while being pivotable and axially shiftable as needed, although while in use they are axially and angularly fixed to the shaft 3. Each rotor plate 13 has for each impact hammer 6 a respective detachable adjusting disk 14 on which the respective impact hammer 6 is eccentrically secured by a pivot pin 15. On the one hand, there is the possibility that the impact hammers 6 can individually pivot back and avoid very hard material so that jamming of the rotor 2 is prevented. On the other hand, loosening the pivot pin 15 allows for the simple replacement of the impact hammers 6. A side-mounted motor 17 drives the shaft 3.

Figure 5:
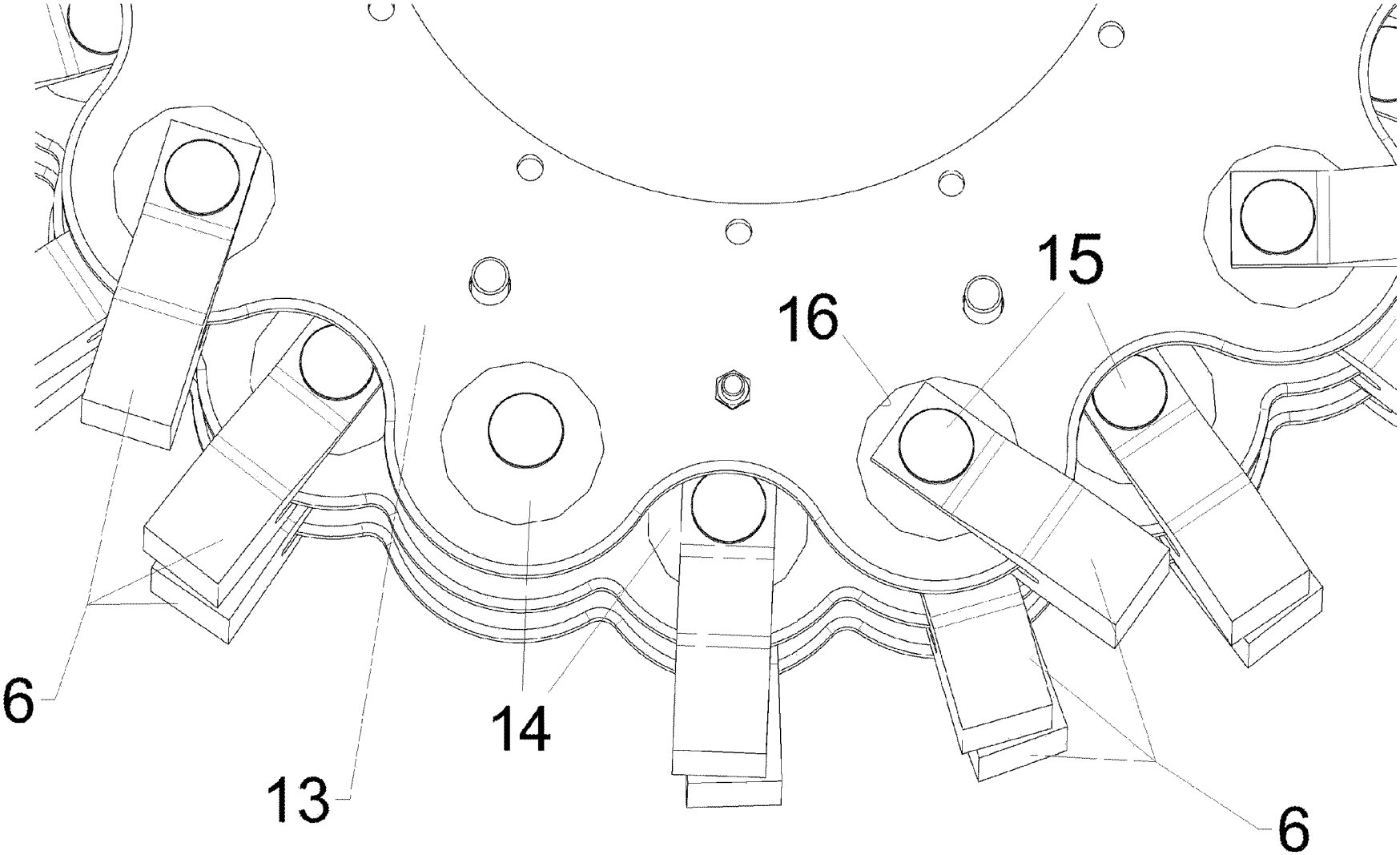
FIG. 5 is a large-scale detail view of a rotor plate having the pivotal impact hammers.

As one can seen in FIG. 5, a radial outer edge of each disk 14 is formed as a regular polygon, and each adjusting disk 14 is set in a respective complementary seat or hole 16 in the plate 13 so that the angular position of the disk 14 can be varied with respect to the rotor plate 13, thereby adjusting a radial spacing between the respective hammer axis defined by the respective pin 15 and the axis A. The number of sides of the polygon can be selected in a largely arbitrary manner, and here the outer edge of each adjusting disk 14 is a dodecagon. The adjusting disks 14 are secured to the rotor plate 13 by complementary fit of the outer edge of each disk 14 and the complementary inner edge of the respective mounting hole 16, and unillustrated formations ensure that the disks 14 are secured in the respective plates 13 during operation of the crusher.

Furthermore, one can see in FIG. 5 that the impact hammers 6 each have a U-shaped inner end into which the edge of the plate 13 and the respective disk 14 engage to grasp around the rotor plate 13 on both sides and are connected to the adjusting disk 14 by the respective pivot pin 15.

Figure 2:
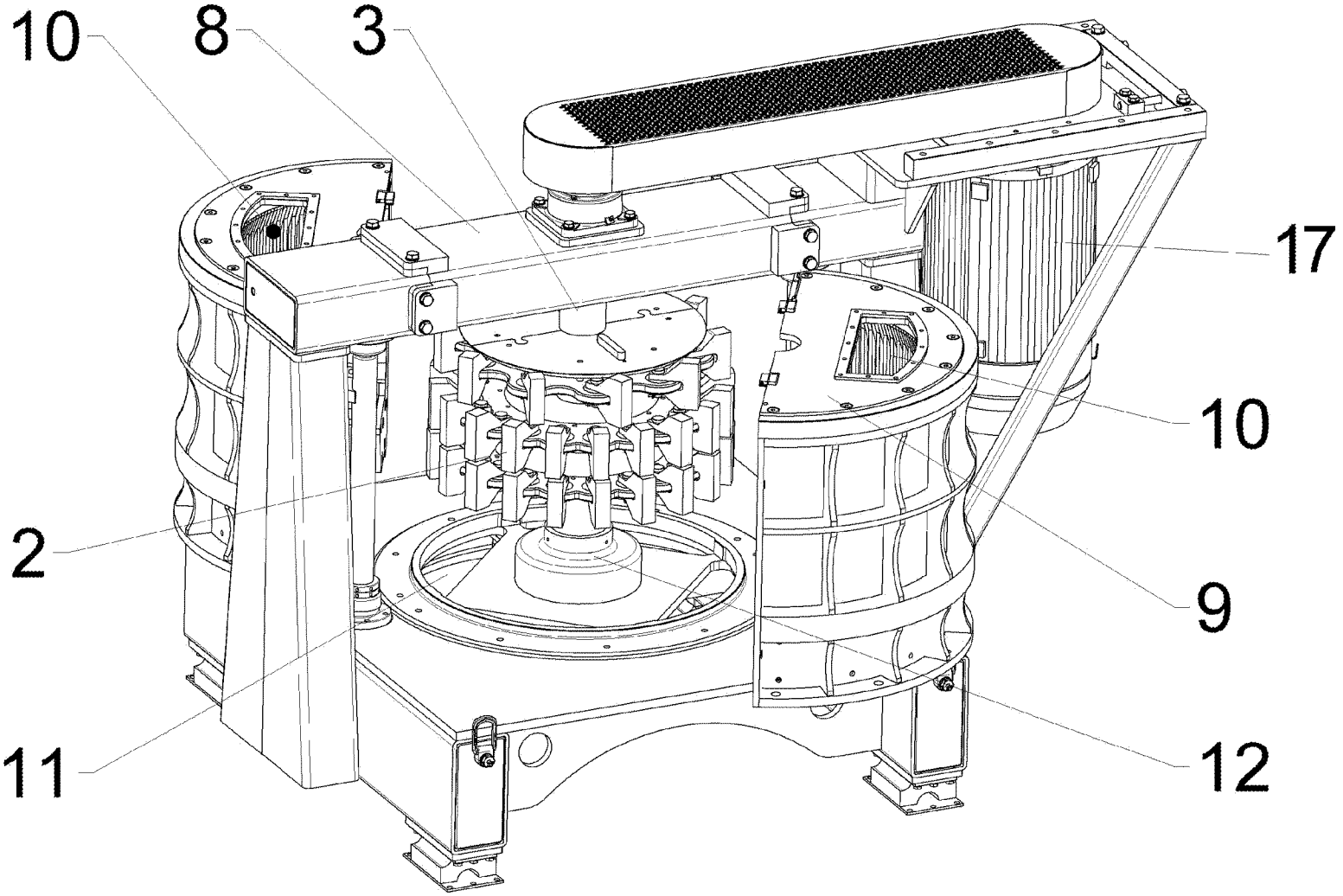
FIG. 2 shows the crusher of FIG. 1 with the shells forming the drum open.

As one can see particularly in FIG. 2, the drum 4 is formed of two identical semicylindrical half-shells 4.1 and 4.2 that are separable from each other and join at a plane including the axis A of the rotor shaft 3. Two mutually same-sized drum half-shells 4.1 and 4.2 are hereby created, which can be easily separated from each other for maintenance work.

As one can also see in FIGS. 1 and 2, each of the two drum half-shells 4.1 and 4.2 is connected at one of its axially extending edges to a respective pivot shaft 7 that is parallel to the rotor shaft 3. The pivot shafts 7 are thereby mounted with their lower end on the machine base 1 and with their upper end on a horizontal upper leg of a recumbent U-shaped machine frame or arm 8 connected to the machine base 1 and crossing it. These shafts 7 diametrally flank the rotor shaft 3.

To easily pivot open the drum half-shells 4.1 and 4.2, they are axially displaceable on the pivot axes 7. This makes opening easier by slightly raising the drum half-shells 4.1 and 4.2, particularly when ground solid material, which can cause friction when opening, has gotten between the lower edge of the drum half-shell and the machine base 1.

To properly absorb the high forces that occur when operating, the drum half-shells 4.1 and 4.2 are bolted at their axially extending edges to each other and/or have their upper and lower edges abutting the machine base 1 bolted to the machine base 1 and arm 8. As one can see in FIGS. 1 to 3, the drum half-shells 4.1 and 4.2 are each closed at their upper end facing away from the machine base 1 by a respective semicircular plate or lid 9. This lid 9 is formed with an intake fill port 10 used on the one hand for the filling with solid material to be ground; at the same time, this port 10 can also be used for supply air.

Similarly, inside the drum 4 at the bottom of the machine base 1, there is provided a discharge or output port 11 through which the ground material on the one hand and exhaust air on the other can be discharged.

The rotor shaft 3 is also mounted in a bearing 12 on the machine base 1 at its lower end as well as on the machine frame 8 on its upper end between the pivot shafts 7.

In the drawing, the ribs 5 rest in a manner not further shown in respective grooves of the drum half-shells 4.1 and 4.2 and have in an alternating manner a variable radial height so that the radially inward protruding ribs 5 grind the solid material.

Last, the arrangement of the impact hammers 6 is selected in such a manner that the distance between them and the ribs 5 decreases vertically downward so that a continuous grinding of the solid material occurs on the way from the fill port 10 at the top to the discharge port 11 at the bottom.

What is claim is:

1. An impact crusher for grinding and separating solid material, the crusher comprising:

a base;

a rotor on the base having an upright shaft defining an upright rotor axis about which the rotor is rotatable and a plurality of vertically spaced and radially horizontally outwardly extending rotor plates each having an outer periphery;

a drum fixed on the base and spacedly surrounding the rotor;

an array of axially extending and angularly spaced replaceable ribs on an inner surface of the drum;

a plurality of adjusting disks removably set in the outer periphery of each of the plates and each rotatable in the respective rotor plate about a respective disk axis parallel to the rotor axis;

an eccentric pivot pin on each of the adjusting disks radially offset from the respective disk axis and defining a respective hammer axis; and respective impact hammers angularly spaced around the outer periphery of each of the rotor plates, each hammer being pivoted on the pivot pin of a respective one of the adjusting disks about the respective hammer axis such that angular displacement of any of the adjusting disks about the respective disk axis displaces the respective pivot pin, the respective hammer axis, and the respective hammers radially of the rotor axis and the drum.

2. The impact crusher according to claim 1, wherein each adjusting disk has a regular polygonal outer periphery and the plates are each formed with a respective circular array of complementary seats having complementarily polygonal inner edges.

3. The impact crusher according to claim 2, wherein the periphery of each disk is a 12-sided polygon.

4. The impact crusher according to claim 1, wherein the pivot pins extend upward and downward past the respective adjusting disks and the hammers have U-shaped inner ends with arms above and below the respective adjusting disk and traversed by the respective pivot pin.

5. The impact crusher according to claim 1, wherein the drum is formed by two mutually separable drum half-shells that meet at a plane including the rotor axis.

6. The impact crusher according to claim 5, further comprising:

respective upright pivot shafts fixed in the base and supporting the drum half-shells for pivoting between a closed position together forming a cylindrical tube laterally enclosing the rotor and an open position exposing the rotor.

7. The impact crusher according to claim 6, wherein the base is provided above the rotor with a horizontal and radially extending arm in which upper ends of the pivot shafts are seated, lower ends of the pivot shafts being seated in the base.

8. The impact crusher according to claim 7, wherein the drum half-shells are axially shiftable relative to the respective pivot shafts.

9. The impact crusher according to claim 6, wherein, in the closed position, axially extending edges of the drum half-shells are bolted to each other or axial end edges of the drum half shells are bolted to the base.

10. The impact crusher according to claim 6, wherein each drum half-shell is provided with a respective horizontal upper semicircular end plate.

11. The impact crusher according to claim 10, wherein at least one of the semicircular end plates is formed with an intake port.

12. The impact crusher according to claim 6, further comprising an upper bearing on the base journaling an upper end of the rotor shaft and a lower bearing on the base journaling a lower end of the rotor shaft.

13. The impact crusher according to claim 1, wherein the base is formed with an outlet port.

14. The impact crusher according to claim 1, wherein the drum is formed with respective axially extending and radially inwardly open grooves in each of which a respective one of the ribs is set.

15. The impact crusher according to claim 1, wherein a radial spacing between orbits of the hammers and inner edges of the ribs decreases vertically downward.

16. An impact crusher for grinding and separating solid material, the crusher comprising:

a base;

a rotor on the base having an upright shaft defining an upright rotor axis about which the rotor is rotatable and a plurality of vertically spaced and radially horizontally outwardly extending rotor plates each having an outer periphery and each formed with a respective circular array of seats with inner edges of regular polygonal shape;

a drum fixed on the base and spacedly surrounding the rotor;

an array of axially extending and angularly spaced replaceable ribs on an inner surface of the drum;

a plurality of adjusting disks each removably set in a respective one of the seats of the plates, each having a regular polygonal outer periphery complementary to that of the respective seat, and each centered on a respective disk axis parallel to the rotor axis, whereby each disk can fit in the respective seat in a plurality of angularly offset positions;

an eccentric pivot pin on each of the disks radially offset from the respective disk axis and defining a respective hammer axis; and respective impact hammers angularly spaced around the outer periphery of each of the rotor plates, each hammer being pivoted on the pivot pin of a respective adjusting disk about the respective hammer axis such that angular displacement of any of the adjusting disks about the respective disk axis displaces the respective pivot pin, the respective hammer axis, and the respective hammers radially of the rotor axis and the drum.

* * * * *